United States Patent [19]

Simpson

[11] 4,289,492

[45] Sep. 15, 1981

[54] CREASING RULE

[75] Inventor: Jack R. Simpson, Toledo, Ohio

[73] Assignee: Container Graphics Corporation, Toledo, Ohio

[21] Appl. No.: 110,780

[22] Filed: Jan. 9, 1980

[51] Int. Cl.[3] ..... B26D 3/08

[52] U.S. Cl. ..... 493/371; 76/107 R; 493/396; 493/468; 493/471

[58] Field of Search ..... 93/59 R, 59 PL, 58.2 F, 93/58.2 R, 58.1, 58 ST, 58 R, 58.3, 58.4; 76/107 R, 107 C

[56] References Cited

U.S. PATENT DOCUMENTS

| | | | |
|---|---|---|---|
| 2,765,716 | 10/1956 | Andersson | 93/58 ST |
| 3,111,067 | 11/1963 | Bishop | 93/58.2 R |
| 3,113,898 | 12/1963 | Tross | 76/107 R |
| 3,383,969 | 5/1968 | Saunders | 93/58 R X |
| 3,673,929 | 7/1972 | Saunders | 93/58.2 R |
| 3,884,132 | 5/1975 | Snodgrass | 93/58.3 X |
| 3,919,924 | 11/1975 | Snodgrass | 93/59 R |

*Primary Examiner*—James F. Coan
*Attorney, Agent, or Firm*—Allen D. Gutchess, Jr.

[57] ABSTRACT

A creasing rule is provided for a cutting die for processing corrugated board. The creasing rule has an elongate, smooth, unbroken web having an outer side and an under side with the outer side having rounded, longitudinally-extending shoulders and a central, longitudinally-extending ridge extending outwardly therefrom at a central portion thereof. A pair of flanges extend outwardly from edges of the web and extend in opposite directions when mounted on a die plate of the cutting die. The under side of the web of the creasing rule has a shallow, longitudinally-extending groove therein which is preferably centrally or symmetrically located with respect to the ridge on the opposite side. The flanges of the creasing rule are affixed to the die plate, usually by staples driven through the flanges.

10 Claims, 5 Drawing Figures

CREASING RULE

This invention relates to cutting dies for cutting and shaping sheet material and particularly to creasing rules for the cutting dies.

Cutting dies for shaping and forming sheet material, usually corrugated board, can be either flat or rotary, although rotary dies are being increasingly used because of the higher production rates achievable therewith. With rotary cutting die equipment, a pair of cylinders are mounted in a frame with a gap of predetermined thickness therebetween. One of the cylinders is of metal and carries a die plate mounted thereon with the appropriate cutting rules and creasing rules. The other cylinder has a yieldable surface, usually a layer of plastic material, which supports the corrugated board when fed between the cylinders as they rotate in opposite directions.

In the fabrication of the cutting dies for this operation, a die plate is first provided on which is laid out the appropriate shape of the blank desired, including cuts, perforations, and fold lines. Saw cuts are then made in the die plate, which is usually of plywood, to provide slots in the proper locations, with the cutting die rules then mounted in the appropriate slots. For producing special lines, such as perforations, specially shaped rules are used in place of the cutting rule. Creasing rules are also mounted on the die plate to produce the fold lines on the sheet material.

Heretofore, some creasing rules have been provided with flanges which are affixed directly to the surface of the die plate. If the thickness of the die plate varies, as is not uncommon, then the creasing rules will not penetrate or crush the corrugated board to the proper extent and will improperly form the indentations or fold lines. Some creasing rules, as shown in U.S. Pat. No. 3,673,929, have had rearwardly-extending, metal flanges which project through slots in the die plate and contact the surface of the metal die cylinder on which the die plate is fastened. The flanges had sufficient height to at least equal or exceed the thickness of the thickest die plate with which the creasing rules might be used, so that the flanges always contacted the cylinder when the die plate was mounted thereon. With that arrangement, the creasing ridges of the creasing rules were always at a predetermined distance from the cylinder, even if the die plate thickness varied. With that type of creasing rule, however, the metal flange contacting the die cylinder would sometimes be work-hardened and break.

The present invention provides a creasing rule which overcomes the disadvantages of both types of creasing rules discussed above. The new creasing rule includes an elongate web of plastic material having a longitudinally-extending ridge centrally located on an outer side thereof. The web also has longitudinally-extending flanges along edges thereof which extend outwardly in opposite directions and are affixed to the surface of a die plate.

On the under side of the web, a shallow, longitudinally-extending groove is centrally located and centrally positioned with respect to the ridge. With the web made of plastic material, this groove enables the web to yield so that the proper fold line is made on corrugated board even if the die plate is thicker than normal. The fold line also will be properly formed with thinner die plates since the creasing ridge on the creasing rule extends farther outwardly from the surface of the die plate than ridges of the solid creasing rules heretofore known.

It is, therefore, a principal object of the invention to provide an improved creasing rule which has the advantages and overcomes the disadvantages discussed above.

Other objects and advantages of the invention will be apparent from the following detailed description of a preferred embodiment thereof, reference being made to the accompanying drawings, in which.

Figure 1:
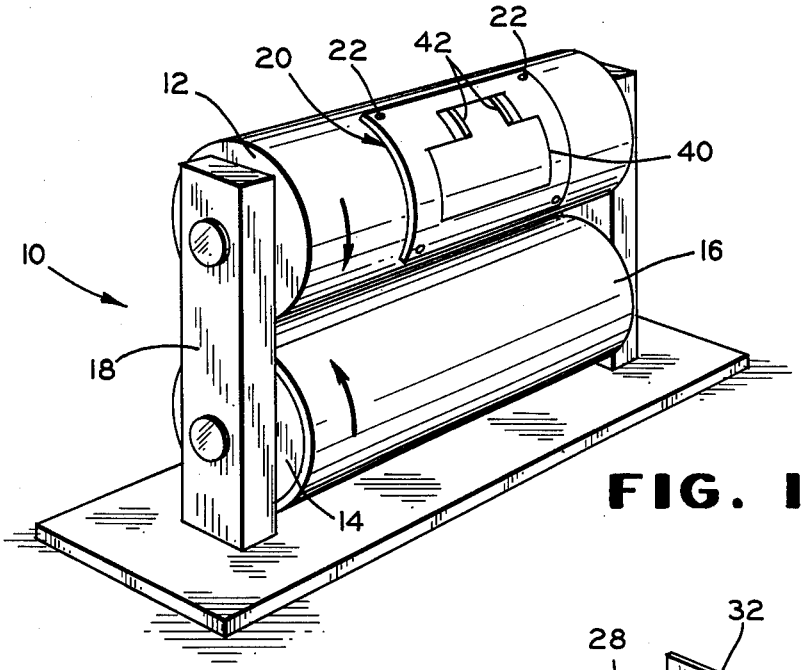
FIG. 1 is a somewhat schematic view in perspective of rotary cutting die equipment embodying the invention.

Referring to the drawings, and particularly to FIG. 1, rotary cutting die equipment is indicated as 10 and includes an upper die cylinder or roll 12 and a lower backup cylinder or roll 14. A resilient layer 16 of polyurethane plastic or other suitable material is located around the backup cylinder 14. The cylinders are rotatably mounted in a frame or stand 18 and are rotated in the direction of the arrows by suitable means (not shown). Corrugated board or similar sheet material is fed between the cylinders 12 and 14 where it is engaged by a rotary cutting die 20 and is shaped into a blank from which cartons or other products can be formed. The cutting die 20 is fastened to the cylinder 12 by any suitable means, such as fasteners 22.

Figure 2:
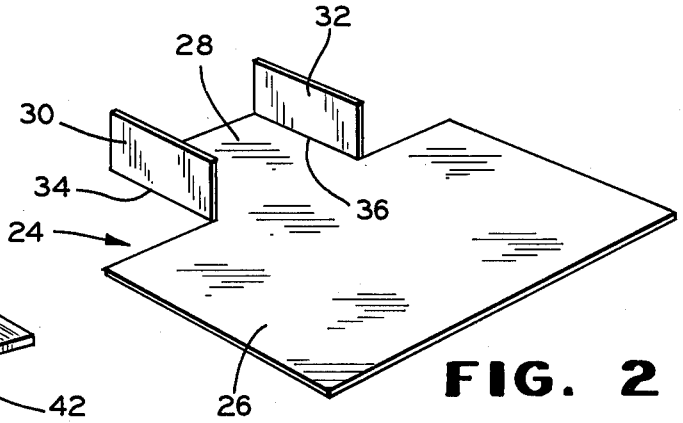
FIG. 2 is a view in perspective of a corrugated board product bent to shape from a blank formed by a rotary cutting die of FIG. 1.

Each rotary cutting die is specially made for a particular carton blank, such as a corrugated board blank 24 of FIG. 2, which is presented solely for illustrative purposes. The blank includes a large rectangular portion 26 and a tab portion 28 having end portions 30 and 32 which are bent out of the plane of the tab 28 along fold lines 34 and 36.

In making the rotary cutting die 20, a die plate 38 (FIG. 5) of appropriate size and thickness is provided. This plate usually is made of high quality, five-eighths inch plywood formed in an arcuate shape with a radius equal to the radius of the cylinder 12. The shape of the blank 24 is then laid out on the die plate 38 and slots are formed in the die plate at appropriate positions to receive cutting rules 40. Joints for the cutting rules can be made in accordance with U.S. Pat. No. 3,383,969.

Figure 3:
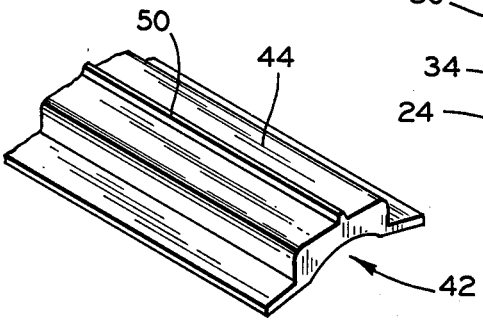
FIG. 3 is a fragmentary view in perspective of a creasing rule in accordance with the invention.
Figure 4:
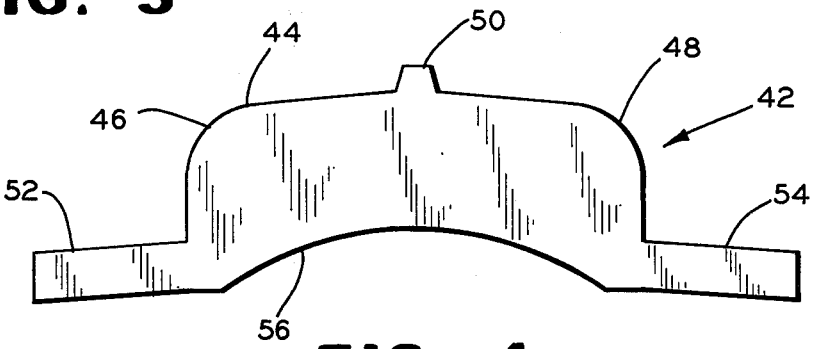
FIG. 4 is an enlarged end view of the creasing rule of FIG. 3.
Figure 5:
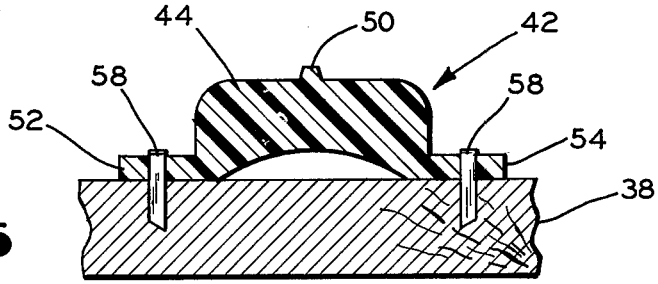
FIG. 5 is a view on a smaller scale in transverse cross section of the creasing rule affixed to a die plate.

To form the fold lines 34 and 36, creasing rules 42 are affixed to the die plate 38 at appropriate positions (FIG. 1), with one of the creasing rules 42 shown more fully in FIGS. 3–5. The creasing rule is made of resilient material such as polyethylene of high molecular weight. It includes an elongate, smooth, unbroken web 44 having an outer side with longitudinally-extending rounded corners 46 and 48 and with a central, longitudinally-extending ridge 50. Flanges 52 and 54 extend outwardly from the edges of the web 44 and slant downwardly in directions away from the outer surface of the web 44 when in an unstressed condition, as shown in FIG. 4.

A shallow, longitudinally-extending groove 56 is located on the underside of the web 44, between the flanges 52 and 54. This groove is centrally located in the underside and is symmetrically positioned with respect to the ridge 50. The groove is preferably of arcuate shape in transverse cross section, which provides more strength and more resiliency for the creasing rule 42. The width of the groove is from one-half to about ninety percent of the width of the web 44 between the flanges 52 and 54. With the height of the ridge 50 being 0.36 inch above the surface of the die plate 38, the depth of the groove 56 is about 0.10 inch. The depth of the groove preferably is from one-fifth to one-half the overall height of the cutting rule 42 for proper resiliency and strength.

The creasing rule 42 can be affixed to the die plate 38 by means of the flanges 52 and 54. This can be accomplished by the use of staples 58, as shown in FIG. 5. When the cutting rule 42 is affixed to the plate, the flanges 52 and 54 are in alignment, which occurs as the cutting rule is curved to an arcuate configuration to match the radius of the die plate 20. Otherwise, the flanges tend to curl up when the cutting rule is curved, if they are initially aligned.

The overall height of the cutting rule is slightly greater than those heretofore known which are solid. Consequently, the ridge can yield downwardly when employed with thicker die plates and still achieve a proper fold line in the corrugated board. A satisfactory fold line is also achieved with thinner die plates because of the greater height of the cutting rule.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A rotary cutting die for processing corrugated board, said die comprising a die plate, a creasing rule comprising an elongate, smooth, unbroken web of plastic material and having a central, longitudinally-extending ridge located on one side thereof, said web having longitudinally-extending flanges along each edge thereof and extending outwardly therefrom in opposite directions, said web having a shallow, longitudinally-extending groove centrally located on the side thereof opposite said ridge, and means for affixing said flanges to said die plate with the ridge extending outwardly therefrom.

2. A rotary cutting die according to claim 1 characterized by said shallow, longitudinally-extending groove of said creasing rule being centrally positioned wth respect to said ridge.

3. A rotary cutting die according to claim 2 characterized by the width of said shallow groove being from one-half to ninety percent of the width of said web.

4. A rotary cutting die according to claim 2 characterized by said groove having a depth from one-fifth to one-half the height of said creasing rule.

5. A rotary cutting die according to claim 1 characterized by said longitudinally-extending groove of said creasing rule being of arcuate configuration in transverse cross section.

6. A creasing rule for a rotary die for processing sheet material, said creasing rule comprising an elongate, smooth, unbroken web having a central longitudinally-extending ridge on one side thereof, said ridge terminating in a flat outer edge, said web having longitudinally-extending rounded corners on the same side as said ridge, said web having longitudinally-extending flanges along each edge thereof and extending outwardly therefrom in opposite directions, said flanges slanting in directions away from the side of said web having said ridge, and a shallow, longitudinally-extending groove centrally located on said web on the side opposite said ridge.

7. A creasing rule according to claim 6 characterized by said shallow, longitudinally-extending groove being centrally positioned with respect to said ridge.

8. A creasing rule according to claim 7 characterized by the width of said shallow groove being from one-half to ninety percent of the width of said web.

9. A creasing rule according to claim 7 characterized by the depth of said shallow groove being from one-fifth to one-half the height of said creasing rule.

10. A creasing rule according to claim 6 characterized by said longitudinally-extending groove being of arcuate configuration in transverse cross section.

* * * * *